US006158552A

United States Patent [19]

Gould et al.

[11] Patent Number: 6,158,552

[45] Date of Patent: Dec. 12, 2000

[54] ADJUSTABLE AND LOCKING STEP STOOL

[76] Inventors: Margaret J. Gould; George W. Gould, both of P.O. Box 124, Katonah, N.Y. 10536

[21] Appl. No.: 09/368,015

[22] Filed: Aug. 3, 1999

Related U.S. Application Data

[60] Provisional application No. 60/095,273, Aug. 4, 1998.

[51] Int. Cl.[7] ..... A47C 3/00

[52] U.S. Cl. ..... 182/200; 182/205; 182/223; 297/423.45

[58] Field of Search ..... 182/33, 222, 223, 182/200, 205; 108/146, 147.19, 147.21; D6/353; 297/423.45; 248/188.5

[56] References Cited

U.S. PATENT DOCUMENTS

| | | | |
|---|---|---|---|
| 329,654 | 11/1885 | Kraemer . | |
| 633,833 | 9/1899 | Goshorn . | |
| 965,471 | 7/1910 | Lehman . | |
| 1,573,691 | 2/1926 | Eichberg . | |
| 2,593,471 | 4/1952 | Mayer . | |
| 3,915,102 | 10/1975 | Barron . | |
| 4,046,348 | 9/1977 | Goodwin . | |
| 4,228,745 | 10/1980 | Gale . | |
| 5,285,992 | 2/1994 | Brown . | |
| 5,437,236 | 8/1995 | Zginer | 248/188.5 |
| 5,479,852 | 1/1996 | Lloyd . | |

FOREIGN PATENT DOCUMENTS

| | | |
|---|---|---|
| 784863A | 12/1980 | U.S.S.R. . |

*Primary Examiner*—Alvin Chin-Shue
*Attorney, Agent, or Firm*—Schmeiser, Olsen & Watts

[57] ABSTRACT

This invention relates generally to an apparatus providing a secure step stool that can assist a user when climbing into an elevated vehicle. The apparatus is adjustable in height and includes foot pads allowing a stabilizing weight to be applied to the step stool.

17 Claims, 6 Drawing Sheets

ADJUSTABLE AND LOCKING STEP STOOL

This application claims benefit of Provisional No. 60/095,273 filed Aug. 4, 1998.

FIELD OF THE INVENTION

The present invention relates generally to step stools used for stepping up or down between two different levels. More particularly, the present invention provides a variable or adjustable height step stool to aid persons entering and exiting transportation vehicles.

BACKGROUND OF THE INVENTION

There has been a constant need to transport small to moderate numbers of people around communities on outings to shopping or events, particularly persons with physical mobility issues such as the elderly or persons with physical handicaps. There are variable heights associated with the doors of vehicles used for this type of transportation. There is also variable terrain associated with places where these vehicles may stop to pick up or discharge passengers. Persons using these vehicles generally require a great deal of assistance. Some passengers must be physically lifted or require another person's support. Typically, much of the physically challenged person's weight needs support because the threshold of the vehicle doorway entrance is high. In an attempt to accommodate persons entering and leaving these vehicles, small plastic or wooden step stools have been used. The landing areas for such step stools are often too small for adequately stepping on the step stool with both feet. Often the step stool weighs too much or is too cumbersome to be readily used. Sometimes the step stool is flimsy in its support so that the passenger is leery of using the step stool. Sometimes the step stool is light in color and/or blends in with the immediate environment so that the height and depth of the steps are not easily perceived. None of the step stools used for this purpose have permitted variable heights for stepping onto the top platform landing area. Many of the currently used step stools require that the assisting person step on the landing area of the step where the passenger must also step if further stabilization of the step stool is needed. None of the step stools used for this purpose have foot pads at the base of the step stool that can be stepped on by the persons assisting the passenger for further stability of the step stool.

SUMMARY OF THE INVENTION

The step stool of the present invention includes an adjustment apparatus allowing the top of the step stool to be placed and locked at variable heights. The step stool has a wider base for better stability. The step stool offers a plurality of foot pads, e.g., at each corner of the step stool base, so that a person can step on the step stool base to provide further stability. The step stool offers a bright coloration to aide in resolution of perception issues. Finally, the step stool can be made from several durable materials which allow for a step stool of less than about 10 lbs for easy management and durability.

The present invention generally provides an apparatus comprising:

a top plate;

a plurality of inner tubes wherein a first end of each inner tube is attached to the top plate;

a hole located in each inner tube;

a plurality of outer tubes, wherein a first end of each outer tube slidingly receives a second end of each inner tube;

a base plate, wherein a second end of each outer tube is attached to the base plate;

a plurality of holes located in each outer tube; and a plurality of adjustment bars, wherein a first portion of each adjustment bar is pivotally attached to the top plate, wherein a second portion of each adjustment bar includes at least one locking pin, and wherein the locking pin passes through one of the plurality of holes in the outer tube and protrudes through the hole in the inner tube.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
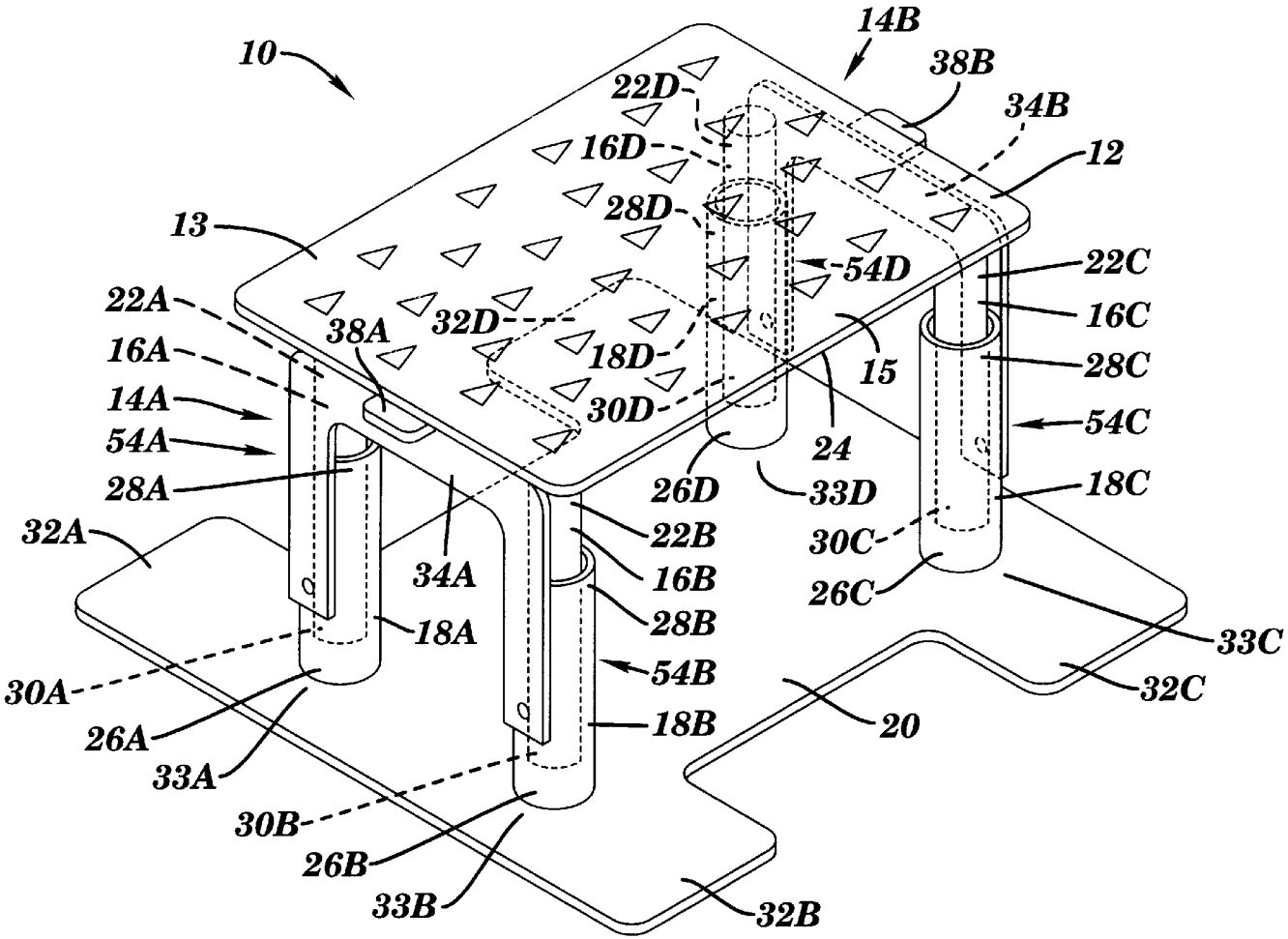
FIG. 1 illustrates a perspective view of a step stool apparatus in accordance with the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present the drawings are not necessarily drawn to scale.

Referring to FIG. 1, there is illustrated a perspective view of a step stool apparatus 10 in accordance with the present invention. The step stool apparatus 10 includes a top plate 12, an adjustment apparatus 14A, 14B, a plurality of inner tubes 16A, 16B, 16C, 16D, a plurality of outer tubes 18A, 18B, 18C, 18D, and a base plate 20. A first end 22A, 22B, 22C, and 22D of each inner tube 16A, 16B, 16C, and 16D, respectively, is attached to the lower surface 24 of the top plate 12. A first end 28A, 28B, 28C, and 28D, of each outer tube 18A, 18B, 18C, and 18D, respectively, slidingly receives a second end 30A, 30B, 30C, and 30D, of each inner tube 16A, 16B, 16C, and 16D, respectively. A second end 26A, 26B, 26C, and 26D of each outer tube 18A, 18B, 18D, and 18D, respectively, is attached to the base 20. The top plate 12 is preferably about 12 inches by 16 inches to provide a surface that a user can step upon. The top plate 12 can be made from any suitable light weight and durable material such as aluminum, plastic, etc. The upper surface 13 of the top plate 12 can be textured or can be coated with a frictional material to prevent a user's foot from slipping when steping onto the step stool apparatus 10. Additionally, the base plate 20, the inner tubes 16A, 16B, 16C, 16D, and the outer tubes 18A, 18B, 18C, 18D, can be made from aluminum or similar light weight and durable material.

The base plate 20 includes a plurality of protruding foot pad portions 32A, 32B, 32C, and 32D extending outwardly from the footprint of the base plate 20. As illustrated in FIG. 1, the foot pad portions 32A, 32B, 32C, and 32D extend substantially beyond the outer boundary 15 of the top plate 12. Additionally, the foot pads 32A, 32B, 32C, and 32D are located adjacent to the four corners 33A, 33B, 33C, and 32D, respectively, of the base plate 20. Thus, a person may easily step upon the foot pads 32A, 32B, 32C, and 32D. The foot pads 32A, 32B, 32C, and 32D increase the width of the base plate 20 which stabilizes the step stool apparatus 10. To further stabilize the step stool apparatus 10, a first person can stand on the foot pads 32A, 32B, 32C, and 32D while a second person is climbing the foot stool apparatus 10. The base plate 20 is preferably about 17 inches by about 19.5 inches.

Figure 2:
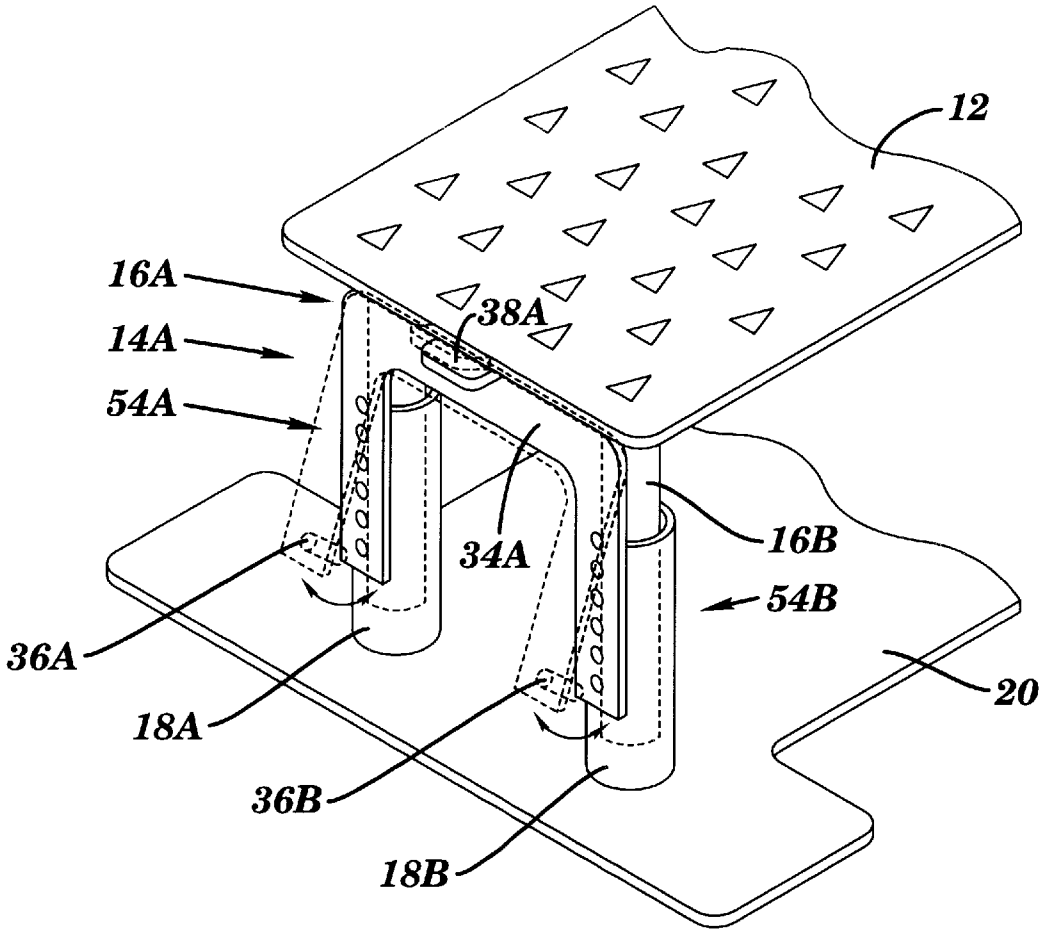
FIG. 2 illustrates a perspective view of a rotated adjustment bar.
Figure 3:
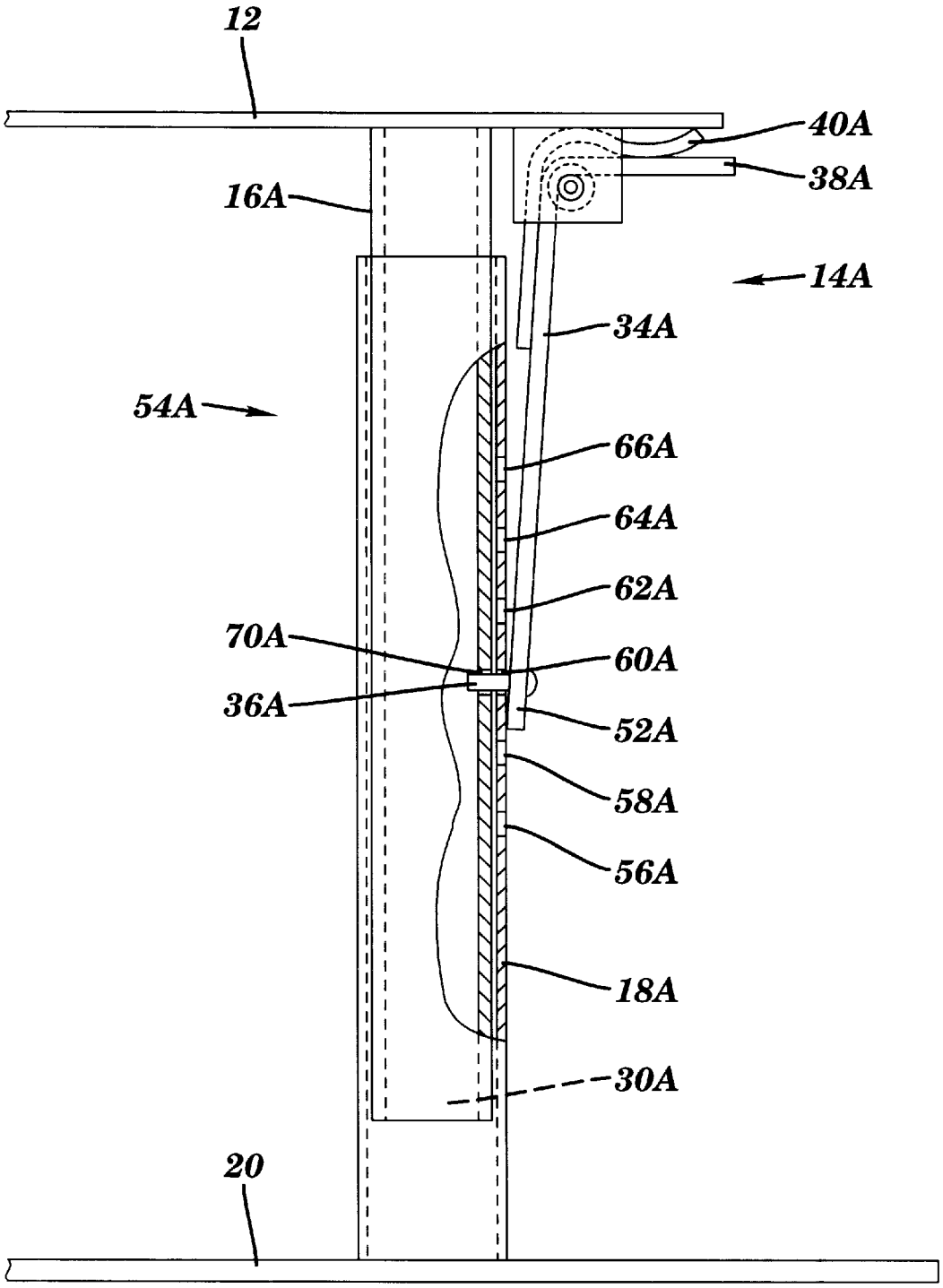
FIG. 3 illustrates a partial cross-sectional side view of the adjustment apparatus.
Figure 4:
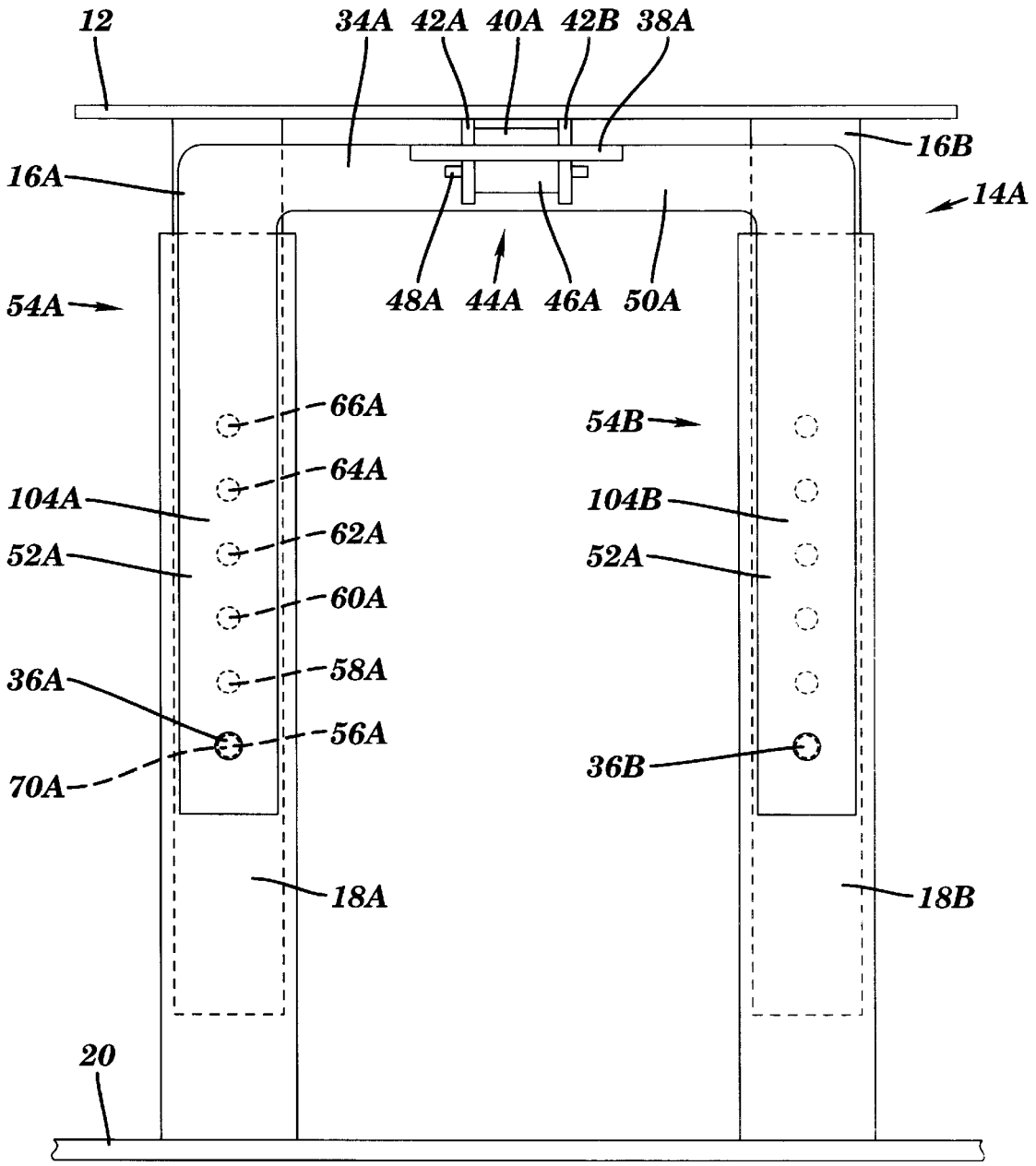
FIG. 4 illustrates an end view of the adjustment apparatus.

FIGS. 1, 2, 3, and 4 illustrate the adjustment apparatus 14A and 14B. The step stool apparatus 10 can be adjusted in height by using the adjustment apparatus 14A and 14B. FIGS. 2, 3, and 4 illustrate a preferred embodiment of the adjustment apparatus 14A, which locks the inner tubes 16A and 16B within the outer tubes 18A and 18B, respectively. In a similar manner, the adjustment apparatus 14B locks the inner tubes 16C and 16D within the outer tubes 18C and 18D, respectively. The adjustment apparatus 14A includes an adjustment bar 34A, locking pins 36A and 36B, an adjustment lever handle 38A, a resilient member 40A, support brackets 42A and 42B, and a pivot apparatus 44A.

Figure 8:
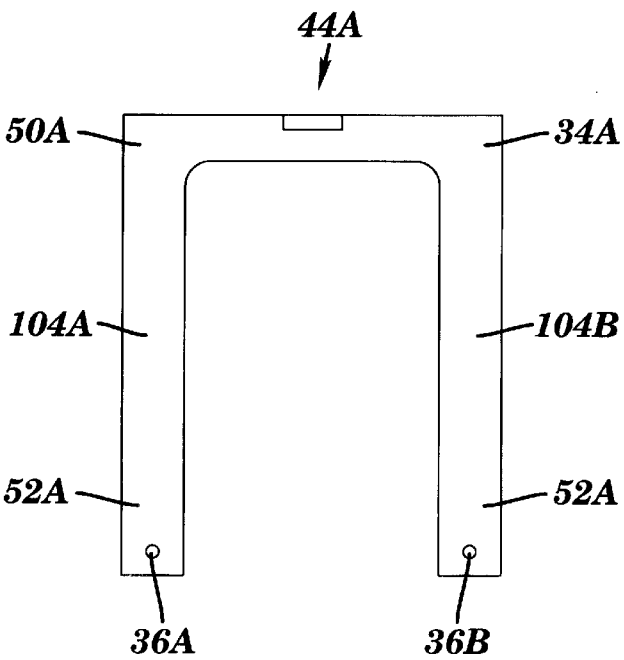
FIG. 8 illustrates a preferred embodiment of the adjustment bar.
Figure 7:
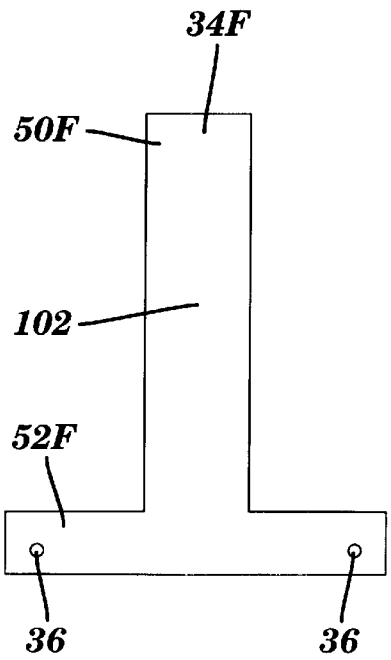
FIG. 7 illustrates another alternate embodiment of the adjustment bar.
Figure 6:
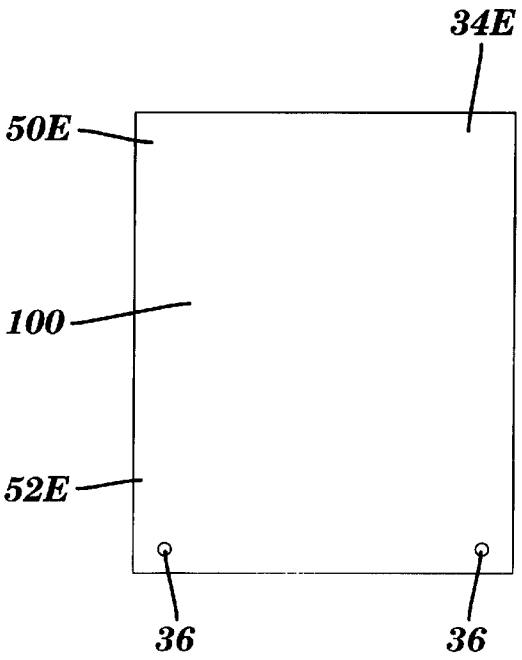
FIG. 6 illustrates an alternate embodiment of an adjustment bar.

The adjustment bar 34 can have various shapes as illustrated in FIGS. 6, 7 and 8. The adjustment bar 34E illustrated in FIG. 6 is in the form of a rectangular plate 100 with a first portion 50E and a second portion 52E. The second portion 52E includes at least one locking pin 36. FIG. 7 illustrates another embodiment of an adjustment bar 34F where the adjustment bar 34F is in the shape of an inverted "T" 102. The adjustment bar 34F includes a first portion 50F and a second portion 52F. The second portion 52F includes at least one locking pin 36. FIG. 8 illustrates the preferred embodiment of the adjustment bar 34A (and 34B) of the present invention. The adjustment bar 34A includes a first portion 50A and a second portion 52A. The adjustment bar 34A is in the form of a "horseshoe" including a leg 104A and a leg 104B. In this case, the second portion 52A includes the legs 104A and 104B. In this preferred embodiment, the locking pin 36A is attached to the leg 104A. Additionally, the locking pin 36B is attached to the leg 104B.

As illustrated in FIG. 4, the pivot apparatus 44A is used to pivotally attach the first portion 50A of the adjustment bar 34A to the top plate 12. The pivot apparatus 44A can include, for example, a body 46A attached to the adjustment bar 34A. The support brackets 42A and 42B are attached to the top plate 12. A pin 48A passes through the support brackets 42A and 42B and through the body 44A, allowing the first portion 50A of the adjustment bar 34A to pivot about the top plate 12. The second portion 52A of the adjustment bar 34A includes at least one locking pin 36 such as 36A as illustrated in FIG. 4. The locking pin 36A is attached to the leg 104A included in the second portion 52A of the adjustment bar 34A and engages with a first set of tubes 54A including the inner tube 16A and the outer tube 18A. Additional locking pins such as 36B can be attached to the leg 104B included in the second portion 52B of the adjustment bar 34A (FIG. 4). The locking pin 36B engages with a second set of tubes 54B including the inner tube 16B and the outer tube 18B.

FIG. 3 illustrates a partial cross-sectional view of the adjustment apparatus 14A and the first set of tubes 54A including the inner tube 16A and the outer tube 18A. The outer tube 18A includes a plurality of holes 56A, 58A, 60A, 62A, 64A, and 66A. The inner tube 16A includes a hole 70A. The locking pin 36A locks the inner tube 16A in a fixed position relative to the outer tube 18A when the locking pin 36A passes through one of the plurality of holes 56A, 58A, 60A, 62A, 64A, or 66A in the outer tube 18A and then passes through the hole 70A in the inner tube 16A. The locking pin 36A is attached to the adjustment bar 34A and is always axially in line with the hole 70A in the inner tube 16A. For example, in FIG. 3, the locking pin 36A is illustrated passing through the hole 60A in the outer tube and through the hole 70A in the inner tube 16A. To raise or lower the top plate 12 relative to the base plate 20, a user presses in an upward direction on the adjustment lever handle 38A, thereby overcoming the restoring force of the resilient member 40A and causing the adjustment bar 34A to rotate away from the outer tube 18A. This removes the locking pin 36A from the hole 70A and the hole 60A. The inner tube 16A is then free to slidingly move up or down relative to the outer tube 18A. When a desired height is reached and the locking pin 36A is aligned with one of the plurality of holes 56A, 58A, 60A, 62A, 64A, or 66A, the user releases pressure on the adjustment lever handle 38A allowing the resilient member 40A to rotate the adjustment bar 34A against the outer tube 18A. This causes the locking pin 36A to pass through the selected hole 56A, 58A, 60A, 62A, 64A, or 66A and through the hole 70A. Thus, the step stool apparatus 10 is locked at the selected height.

The locking pin 36A may be any suitable protrusion attached to the adjustment bar 34A, such as a rivet or a cylinder welded to the adjustment bar 34A. The adjustment bar 34A and the locking pin 36A may be made from any hard suitable material such as steel. The resilient member 40A may be any suitable member (i.e., a leaf spring, a coil spring, a torsion spring, etc.). The adjustment lever handle 38A may be formed by bending an extended portion of the adjustment bar 34A at an angle of about 90 degrees. Typically, the holes 56A, 58A, 60A, 62A, 64A, and 66A are spaced about 0.75 inches apart, providing a height adjustment range from about 6.6 inches to about 10.25 inches. Additionally, the second end 30A of the inner tube 16A rests against the base 20, when the locking pin 36A enters the lower hole 56A in the outer tube.

Figure 5:
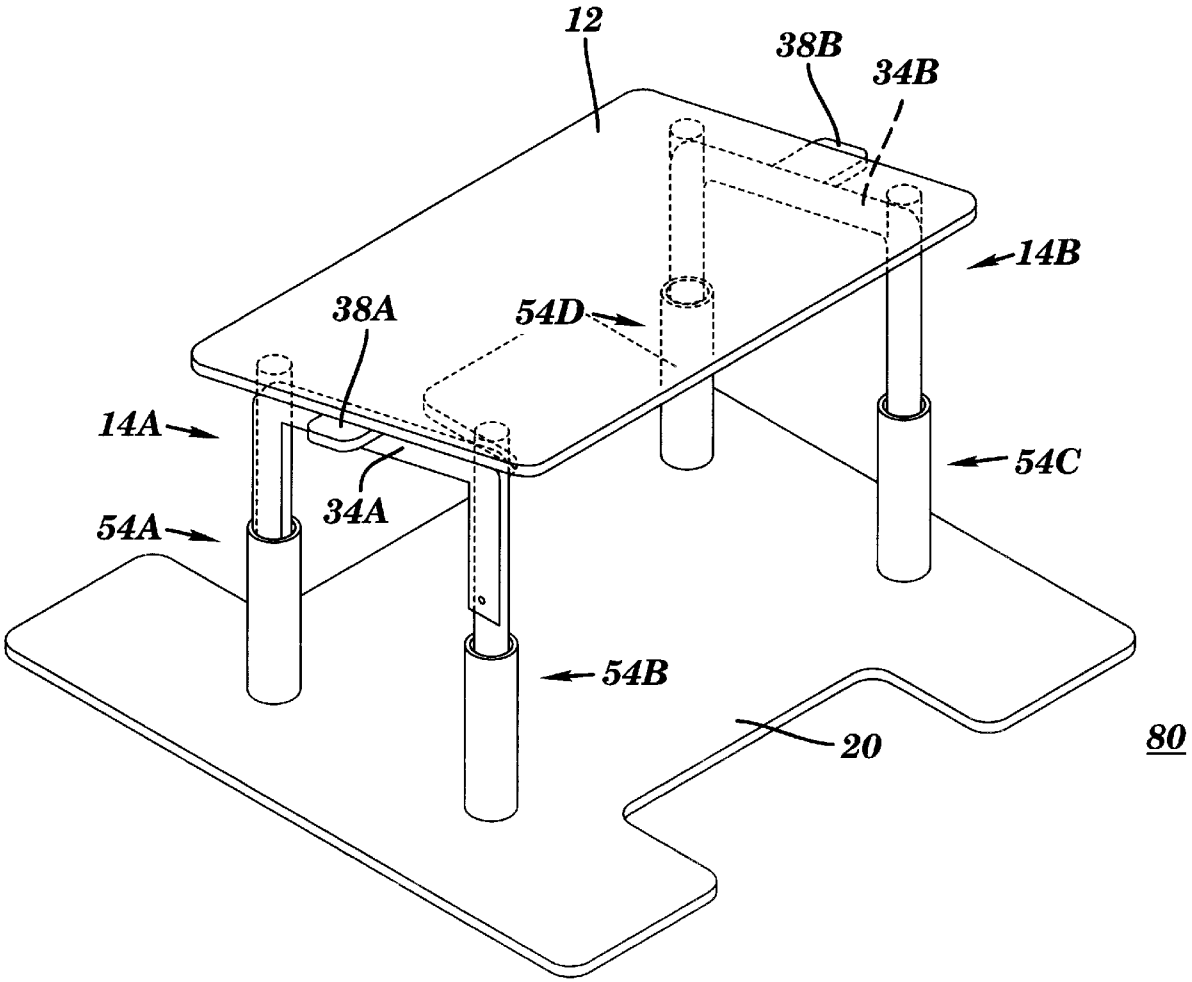
FIG. 5 illustrates a perspective view of the step stool apparatus resting on an uneven ground.

FIG. 3 illustrates the locking pin 36A attached to the second portion 52A of adjusting bar 34A. The locking pin 36A is engaging the first set of tubes 54A including the inner tube 16A and the outer tube 18B. FIG. 2 and FIG. 4 illustrate the locking pin 36B attached to the second portion 52A of adjusting bar 34A engaging the second set of tubes 54B including the inner tube 16B and outer tube 18B. Thus, one adjusting bar 34A may include locking pins 36A and 36B that can engage a plurality of sets of tubes such as 54A and 54B. In a similar manner, the adjusting bar 34B (FIG. 1) can engage a third set of tubes 54C including inner tube 16C and outer tube 18C. Additionally, the adjusting bar 34B can engage a fourth set of tubes 54D including inner tube 16D and outer tube 18D. In use, an operator can lift the adjustment lever handles 38A and 38B which frees all four sets of tubes. Next, the operator can raise, lower, or tilt the top plate 12 relative to the base plate 20. Finally, the operator releases the adjustment lever handles 38A and 38B locking the top plate 12 in the desired position. As illustrated in FIG. 5, the top plate 12 may be tilted relative to the base plate 20 to compensate for an uneven ground 80. Thus, top plate 12 can be positioned in a horizontal position to allow a person to securely climb the step stool apparatus 10.

The foregoing description of the present invention has been presented for purposes of illustration and description. It is not intended to be exhaustive or to limit the invention to the precise form disclosed, and many modifications and variations are possible in light of the above teaching. For example, the step stool may be used in any situation where a portable step stool apparatus is required, such as entering a building or an airplane. The step stool may further include a bright coloration such as red or yellow to facilitate visual depth perception. Such modifications and variations that may be apparent to a person skilled in the art are intended to be included within the scope of this invention as defined by the accompanying claims.

What is claimed is:

1. An apparatus comprising:

a top plate;

a plurality of inner tubes, wherein a first end of each inner tube is attached to the top plate;

a hole located in each inner tube;

a plurality of outer tubes, wherein a first end of each outer tube slidingly receives a second end of each inner tube;

a base plate, wherein a second end of each outer tube is attached to the base plate;

a plurality of holes located in each outer tube; and a plurality of adjustment bars located outside the plurality of outer tubes, wherein a first portion of each adjustment bar is pivotally attached to the top plate, wherein a second portion of each adjustment bar includes at least one locking pin, and wherein the locking pin extends from the adjustment bar outside the outer tube and passes through one of the plurality of holes in the outer tube and protrudes through the hole in the inner tube.

2. The apparatus of claim 1, further including a plurality of resilient members, wherein each resilient member is attached to each adjustment bar and contacts the top plate providing a force to hold the locking pin in one of the plurality of holes in the outer tube and in the hole in the inner tube.

3. The apparatus of claim 1, wherein the adjustment bar further includes an adjustment lever handle for rotating the adjustment bar to remove the locking pin form one of the plurality of holes in the outer tube.

4. The apparatus of claim 1, wherein at least two locking pins are provided on the adjustment bar to engage the holes in at least two sets of the inner and outer tubes.

5. The apparatus of claim 1, wherein the base plate further includes a plurality of foot pad portions protruding from the base for receiving a foot of a user.

6. The apparatus of claim 5, wherein the foot pad portions extend beyond a boundary of the top plate.

7. The apparatus of claim 5, wherein the foot pad portion are located at the corners of the base plate.

8. The apparatus of claim 2, wherein each resilient member is a leaf spring.

9. The apparatus of claim 2, wherein each resilient member is a coil spring.

10. The apparatus of claim 1, wherein the top plate, base plate, inner tubes, and outer tubes are aluminum.

11. The apparatus of claim 1, wherein the plurality of adjustment bar and the locking pins are steel.

12. The apparatus of claim 1, wherein each adjustment bar includes at least two legs, wherein each leg includes at least one locking pin.

13. The apparatus of claim 1, wherein there are four inner tubes received within four outer tubes.

14. The apparatus of claim 1, wherein each adjustment bar is in a horseshoe shape.

15. The apparatus of claim 1, further including a textured top surface of the top plate to prevent slipping.

16. The apparatus of claim 1, further including a frictional material on a top surface of the top plate.

17. The apparatus of claim 1, wherein the base plate is tiltable relative to the top plate.

* * * * *